United States Patent [19]

Pitchford

[11] Patent Number: 4,832,393

[45] Date of Patent: May 23, 1989

[54] MOVING/LIFTING DEVICE WITH A STRAP

[75] Inventor: Henry F. Pitchford, Voorhees, N.J.

[73] Assignee: Kenneth Thomas, Haddonfield, N.J.

[21] Appl. No.: 180,463

[22] Filed: Apr. 11, 1988

[51] Int. Cl.[4] ..... A44B 11/10; B65D 71/00

[52] U.S. Cl. ..... 294/156; 24/196; 294/31.2

[58] Field of Search ..... 294/31.2, 74, 119.2, 294/137, 147, 149–157, 164, 165, 167, 168, 170; 24/16 R, 68 R, 68 A, 115 H, 115 K, 136 R, 171, 181, 194, 196

[56] References Cited

U.S. PATENT DOCUMENTS

| | | | |
|---|---|---|---|
| 504,307 | 8/1893 | Roberts | 294/157 X |
| 1,056,068 | 3/1913 | Sprague | 294/156 |
| 2,427,246 | 9/1947 | Whittington . | |
| 2,485,864 | 10/1949 | Cohen et al. . | |
| 2,832,521 | 4/1958 | Gardner | 294/154 X |
| 2,997,218 | 8/1961 | Kobles | 294/150 |
| 3,078,536 | 2/1963 | Bauer | 24/194 |
| 3,119,160 | 1/1964 | Hoppeler | 24/16 |
| 3,167,227 | 1/1965 | Walden . | |
| 3,795,947 | 3/1974 | Thompson | 24/196 X |
| 3,798,711 | 3/1974 | Cousins | 24/196 X |
| 4,131,976 | 1/1979 | Bengtsson | 24/196 |
| 4,592,582 | 6/1986 | Lavender et al. | 294/137 |
| 4,696,505 | 9/1987 | Shadoan | 294/153 |

FOREIGN PATENT DOCUMENTS

| | | | |
|---|---|---|---|
| 2307807 | 8/1974 | Fed. Rep. of Germany | 294/147 |

*Primary Examiner*—Johnny D. Cherry
*Attorney, Agent, or Firm*—Thomas A. Lennox

[57] ABSTRACT

A device to lift objects with a single strap including a center panel attached directly to a handle, the panel sliding up and down between a pair of housing panels with alignable slot openings through the two panel members and the center panel, the combined opening being sufficient to receive a free end of the strap with the other end of the strap securely fastened to the opposite side of the device so that when the strap is wrapped around the object to be lifted, and the free end inserted through the combined openings lifting on the handle immediately grabs the strap and releasing of the handle immediately releases the strap.

20 Claims, 4 Drawing Sheets

MOVING/LIFTING DEVICE WITH A STRAP

BACKGROUND OF THE INVENTION

This invention involves a device for moving a body that is of a shape and size capable of being moved with a single strap. In particular, this invention is effective to lift a body with a single strap.

The use of strap to attach to objects that are to be moved or lifted is well known and a number of varying types of devices have been provided to securely attach the ends of the strap after they have been encircled around the device. These include buckles and various types of devices which prevent the strap from slipping as tension is placed on the strap to lift or move the body. These devices tend to be somewhat complicated requiring that the strap interleaf back over itself requiring the person attaching the strap to go through a series of maneuvers almost akin to tying the strap in a knot. Buckles have a tendency to abrade the strap utilizing sharp teeth or serrated surfaces to grip the strap and prevent it sliding and loosening and possibly drop the body being moved. Many of these devices allow the strap to be securely fastened, but require a major effort to disengage the strap from around the body, particularly after it has been pulled tightly to lift or move a heavy object.

Despite these problems of attaching the strap and holding it secure during the lifting process, while allowing it to be easily disengaged, the strap is virtually the only answer to lifting bulky bodies and objects, particularly those of a size and shape that are difficult to grab. A simple device is needed to lift a strap after it has encircled the body to be moved and provide easy attachment and disengagement of the strap. None of the prior art devices provide this combination and none attain the objects described hereinbelow.

SUMMARY OF THE INVENTION

An object of this invention is to provide a device capable of moving a body which is of a size and shape capable of being moved with a single strap encircling the body.

It is a particular object of the present invention to provide a lifting device that includes a shape which is easily attachable to the source of the force available to move the body. This shape includes a handle for hand lifting, but also includes a hook or eye capable of attaching to a cable or chain for lifting or moving the body with mechanical means.

It is a specific object of the present invention to provide a moving device using a single strap which allows essentially immediate grabbing of the strap when force is applied to the device to move the body in the direction desired.

It is an additional object of the present invention to provide a device for lifting a body with a strap wrap around the body and held by the device during the moving process, but providing essentially immediate release without jamming of the strap, when the force moving the object is released, allowing the strap to be easily disengaged.

It is a further object of the present invention to provide a device for lifting a body with a strap wherein the strap is easily attachable to the device without the necessity of an additional locking device or pressure mechanism on the strap wherein the lifting mechanism is the locking device.

It is an additional object of the present invention to provide a device using a strap to move a body wherein attachment of the strap to the device is accomplished without weakening the strap either by holes or braiding the strap and without the necessity of grommets.

It is a specific object of the present invention to provide a device that is capable of moving a body with a strap wherein the force of movement of the device is capable of being distributed over the entire cross-section of the strap without concentration of stress.

It is a particular object of the present invention to provide a device capable of moving a body wherein attachment of the strap to the device after encircling the body is accomplished without the necessity of a separate strap connection.

It is a particular object of the present invention to provide a device capable of moving a body with a strap wherein pulling to move locks the strap in position and upon releasing the pulling force the device unlocks the strap from the device. This invention is a device to move a body capable of being moved with a single strap including a center panel member having a front portion facing forwardly toward a direction the body will be moved, a rear portion facing rearwardly toward the body to be moved, and two faces. The device further includes a movement attachment means attached to the center panel proximate the front portion to connect to a movement means to cause the center panel proximate the front portion to connect to a movement means to cause the center panel to be moved longitudinally in a plane of the panel toward the front and back toward the rear. The device further includes a housing including a pair of housing panel members fixed in a parallel face to face relationship with the faces of the center panel interposed between opposing faces of the housing panel members, the distance between the faces being sufficient to allow the center panel to freely slide back and forth between the housing panel members. The device further includes a strap of a length sufficient to encircle around the body to be moved, with one end attached to the housing in lateral alignment with the front portion and the other end free. The device further includes a center panel opening through the center panel forming a first edge oriented laterally with and facing the front portion, and a pair of housing openings oriented laterally with the front portion through each housing panel member. The housing openings are positioned opposed to each other and in alignment with each other, and each of these housing openings form a second edge oriented laterally with the front portion, opposing the first edge, and facing away from the front portion. The housing openings are positioned such that they are alignable with the panel opening by movement of the center panel to form a slot-like opening of sufficient size and shape to receive the free end of the strap. The device further provides that the strap has a thickness and the distance between the center panel first edge and the housing panel second edge on each side is sufficient to essentially immediately catch the strap between the second edges of the housing panel openings and the first edge of the center panel opening when the movement attachment means and thus the center panel is moved toward the front and essentially immediately release the strap when the movement attachment means is moved toward the rear. A preferred device further includes a stop means to stop rearward movement of the center panel and align the center panel opening with the housing panel openings to form the slot-like opening. A preferred device is where the housing panel members have outside faces facing in opposite directions and the strap is attached to one outside face proximate to and toward the rear from the second opening through the housing panel member and the free end of the strap is fed through the second opening through the outside face of the opposite outside face after the strap is encircled around the body to be moved.

The invention is a method to move a body of a size and shape sufficient to being moved with a single strap including providing a center panel member having a front portion, a rear portion, and two faces and forming a housing including structurally attaching a pair of housing panel members in a parallel face to face relationship and interposing the center panel between opposing faces of the housing panel members, the distance between the faces being sufficient to allow the center panel to freely slide back and forth between the housing panel members. The method further includes attaching one end of a strap to the housing in lateral alignment with the front portion and leaving the other end free, the strap being of a length sufficient to encircle the body to be moved. The method further includes forming a center panel opening through the center panel with a first edge oriented laterally with and facing the front portion and forming a pair of housing openings oriented laterally with the front portion through each housing panel member, the housing openings being positioned opposed to each other and in alignment with each other, and each having a second edge oriented laterally with the front portion, opposing the first edge, and facing toward the rear. The method further includes positioning the housing openings such that they are alignable with the panel opening by movement of the center panel and sliding the center panel toward the rear to form an unobstructed slot-like opening through both housing openings and through the center panel opening of sufficient size and shape to receive the free end of the strap. The method further includes encircling the strap around the body to be moved, inserting the free end of the strap through the slot-like opening from the side opposite that where the other end of strap is attached, and pulling the strap taut around the body. The method further includes sliding the center panel frontwardly catching the strap between the second edges of the housing panel openings and the first edge of the center panel opening, and pulling the front portion of the center panel with sufficient force to move the body. A preferred method further includes moving center panel rearwardly to essentially immediately release the strap.

A preferred embodiment of this invention is a device to lift a body capable of being lifted with a single strap; this description using a lifting up or depositing down, not only because lifting is an important function of the invention, but also because it is a mere convenience for describing the spatial relationship among the elements of device. This device includes a center panel member having an upper edge and two faces, the center panel being upstanding such that the faces are vertically aligned. The device further includes a handle means attached to the center panel proximate the upper edge to allow the center panel to be vertically lifted or lowered. The device further includes a housing including a pair of housing panel members fixed in a parallel face to face relationship with the center panel interposed between opposing faces of the housing panel members, the distance between the faces being sufficient to allow the center panel to freely slide up and down between the housing panel members. The device further includes a strap of a length sufficient to extend vertically around the body to be lifted, with one end attached in a horizontal alignment to the housing and the other end free. The device further includes a horizontally oriented slot through the center panel with a lower edge and of a size and shape to receive the free end of the strap, and a pair of horizontally oriented slot-like openings through each housing panel member, the openings being positioned opposed to each other and in alignment, each opening having an upper edge, and the openings being positioned such that the slot is alignable with the openings as the center panel is moved vertically. The strap has a thickness and the distance between the housing panel members are sufficient to essentially immediately catch the strap between the upper edges of the openings and the lower edge of the slot when the handle means is lifted and essentially immediately release the strap when the handle means is moved downwardly to place slack in the strap. A preferred device further includes a stop means to stop downward movement of the center panel and align the slot with the openings. A further preferred device includes the housing panel members having outside faces facing in opposite directions and the strap being attached to one outside face proximate to and below the opening through that panel member and the free end being feedable through the opening in the opposite outside face after the strap is looped around the body to be lifted.

BRIEF DESCRIPTION OF PREFERRED EMBODIMENTS

FIG. 8 is an enlarged sectional section of the cross-sectional view of FIG. 7.

FIG. 9 is a diagram illustrating the position and dimensions of the device in a cross-sectional view essentially identical to that illustrated in FIG. 8.

DESCRIPTION OF PREFERRED EMBODIMENTS

Figure 1:
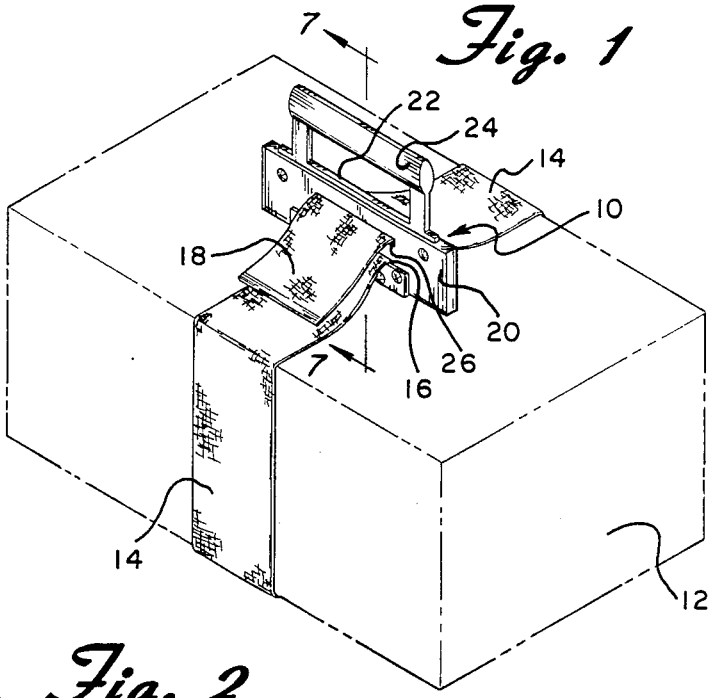
FIG. 1 is a perspective view of a moving device shown ready to lift a box.
Figure 2:
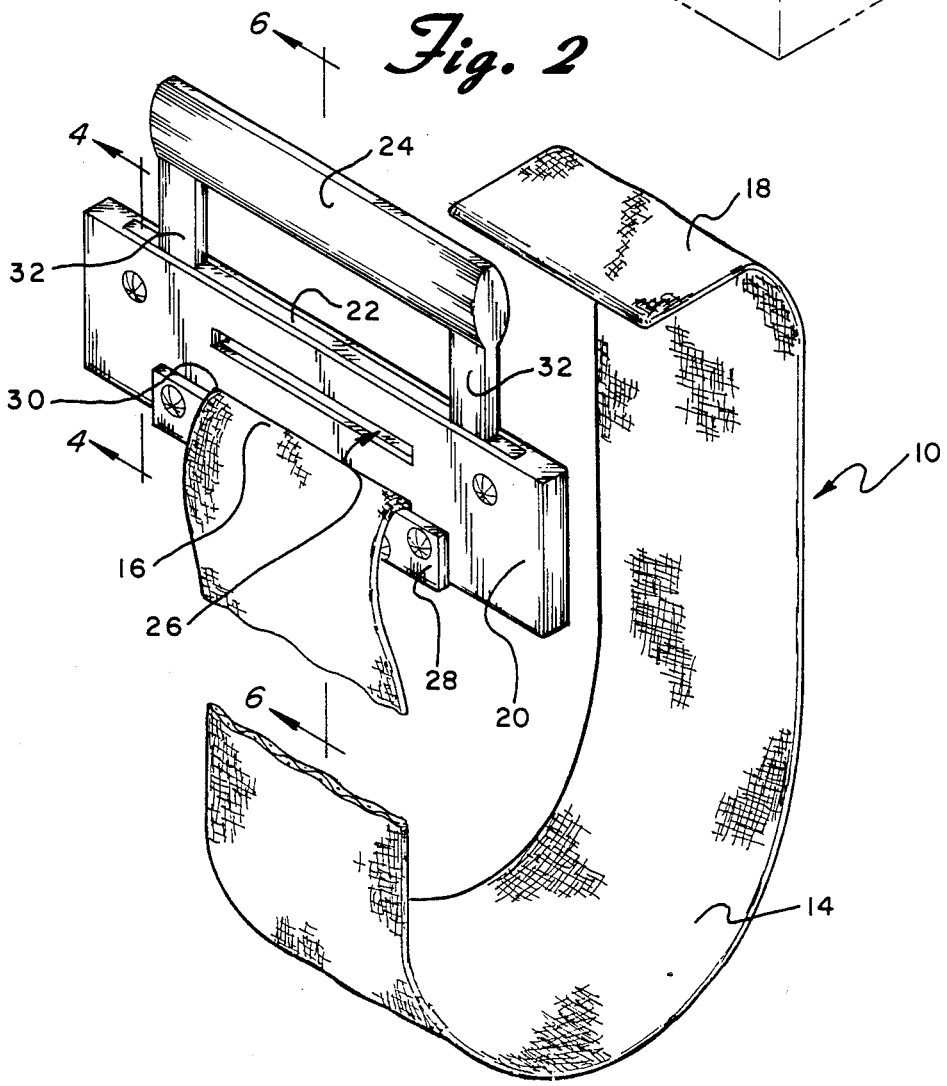
FIG. 2 is a perspective view of the device illustrated in FIG. 1 before the free end of the strap is engaged.
Figure 3:
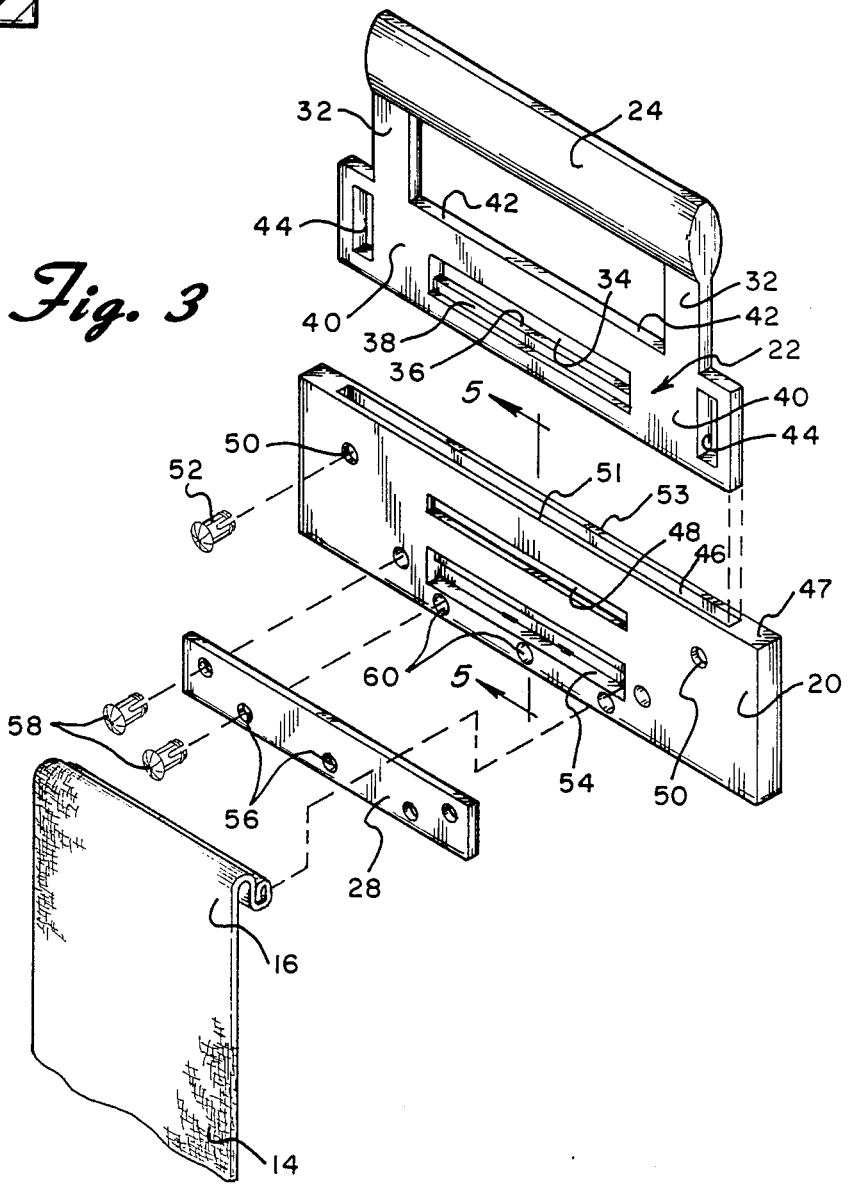
FIG. 3 is an exploded perspective view of the device illustrated in FIG. 1.

In FIG. 1, device 10 is used to move and, as pictured, to lift box 12 with strap 14 encircled around and under box 12. End 16 of strap 14 is securely fastened to body 20 of device 10. Free end 18 of strap 14, after encircling box 12 is inserted through combined slot opening 26 through housing 20. Center panel 22 which is an integral part of handle 24 is lifted, strap 14 is grabbed and box 12 is lifted. As further illustrated in FIG. 2, strap end 16 is inserted into opening 30 into housing 20 and is securely fastened with strap plate 28. In this figure, handle 24 which is attached through handle attachment members 32 to center panel 22 is allowed to drop downwardly against a stop, opening up combined slot 26 into which strap end 18 is inserted. In FIG. 3 and in all of the figures, positions and directions are described in relation to a frontwardly direction toward the direction the body is to be moved. In this case box 12 will be lifted in a forwardly direction and device 10 will be dropped in a rearwardly direction toward the box. In these figures, since the movement is against gravity and upwardly, the frontwardly direction is synonymous with upwardly and the rearwardly direction is synonymous with downwardly. However, when the body is to be dragged against frictional resistance, the frontwardly and rearwardly directions apply also. In FIG. 3, center panel 22 includes front facing edge 42 and side faces 40. As center panel 22 is slidably inserted into front to rear opening 46 in housing 20, faces 40 slidably engage the inside faces of opening 46 with the typical tolerance being about 1 to 8 millimeters on each side and preferably about five millimeters on each side to ensure ease of sliding of center panel 22 in a frontwardly and rearwardly direction. Center panel 22 is prevented from frontward removal by rivets 52 through holes 50 in housing 20 and through slots 44 in center panel 22. The length of slots 44 allow center panel 22 to ride freely forwardly and rearwardly and do not act as a stop except for frontward removal. Face 38 and an identical hidden face 38' on the opposite side of panel 22 reduce the central thickness of panel 22. This center section reduction in thickness is immediately below center panel opening 34 which is of sufficient width and length to easily receive strap end 18. Front facing edge 36, in this view the bottom face of opening 34, is important as it engages the strap. Housing 20 includes housing opening 48 which opens through housing panel 51 which is opposed and in alignment with housing opening 49 (hidden in this view) through housing panel 53. Housing openings 48 and 49 when in alignment with center panel opening 34 combine to provide opening 26 through which strap end 18 may be easily threaded. Housing 22 also includes strap attachment opening 54 which is of sufficient size to receive end 16 of strap 14 which is securely fastened to housing 20. After strap end 16 is inserted in opening 54, strap securing panel 28 is secured with rivets 58 through holes 56 to hold strap end 16 in place. Strap end 16 extends over strap securing panel 28 so that rearward forces are directed against panel 28 and there is little or no twisting of handle 24 when a body is lifted or moved by the device. The attachment point of strap end 16 is preferably about one-quarter to about one inch below the top edge of openings 48 and 49 and is more preferably about one-half to about three-quarter inch below the top edge of openings 48 and 49.

Figure 4:
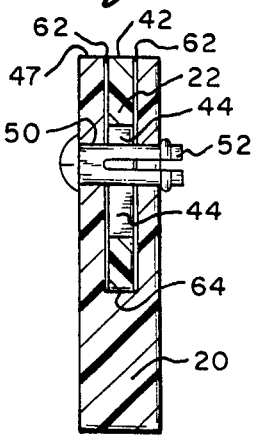
FIG. 4 is a cross-sectional view taken along lines 4—4 of FIG. 2.
Figure 5:
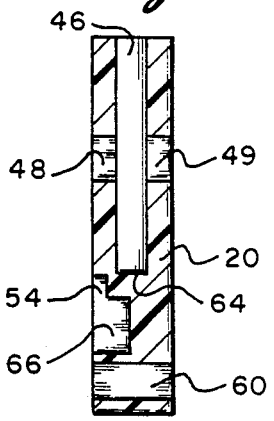
FIG. 5 is a cross-sectional view taken along lines 5—5 of FIG. 3.

In FIG. 4, center panel 22 is a rest stop position against stop 64, the bottom of opening 46. Plastic rivets 52 extend through holes 50 extending through housing panel 51, slots 44 and the extension of hole 50 through housing panel 53. In FIG. 5, with center panel 22 removed, housing openings 48 and 49 cut through housing panel 51 and 53 respectively. Strap attachment opening 54 is seen opening into cavity 66 of a size sufficient to hold and trap strap end 16 folded over and around itself to be held in place with strap security panel 28 held on with plastic rivets through holes 60.

Figure 6:
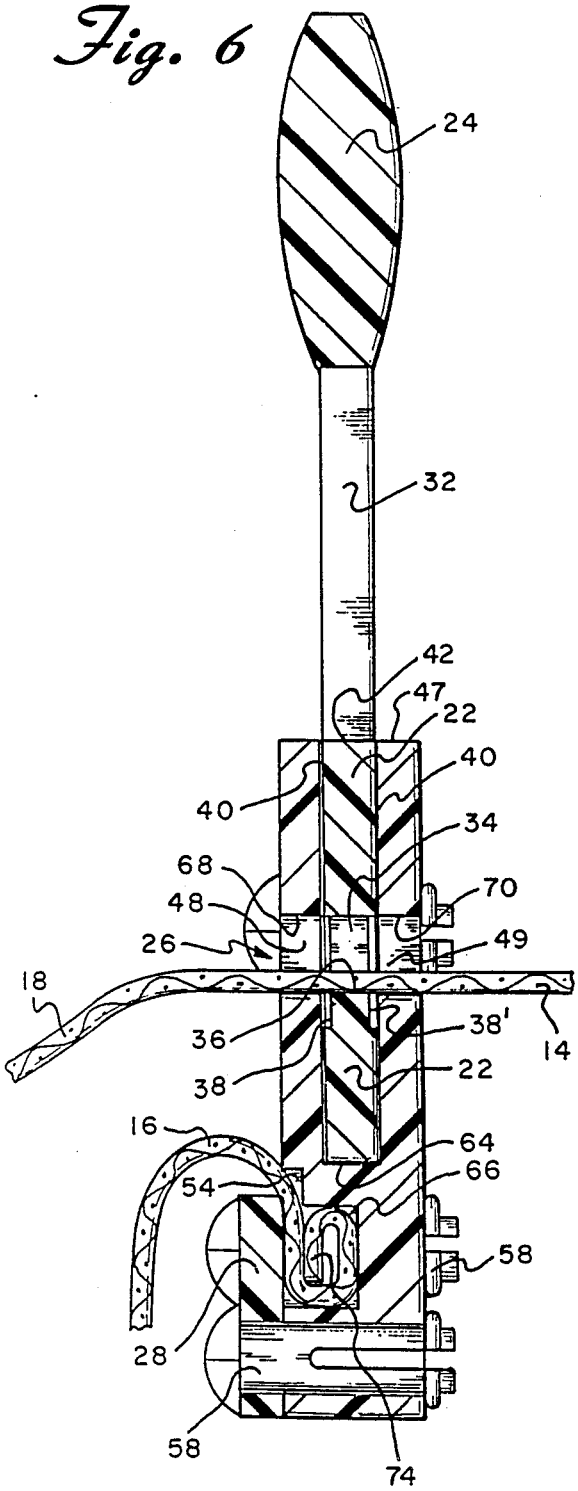
FIG. 6 is cross-sectional view taken along lines 6—6 of FIG. 2 after the end of the strap has been inserted into the device.

In FIG. 6, center panel 22 has been allowed to drop against stop 64 opening up a combined slot 26 which is an alignment of openings 48, 34 and 49. Strap end 18 has been inserted through opening 26 and pulled tight after encircling the body to be lifted. The reduced cross-section (thickness) of center panel 22 is obtained by recessed surfaces 28 which provide a recess from both sides to reduce the width of front facing edge 36 at the bottom of opening 34. Rear facing edge surfaces 68 and 70 are at the top of openings 48 and 49 respectively. When panel 22 is pulled frontwardly, edge surface 36 will carry strap 14 in a frontward direction until it engages surfaces 68 and 70. Strap end 16 is attached to housing 20 by folding the end of the strap over itself to form a bundle 74 which is inserted into cavity 66 with the strap extending out through opening 54. Strap securing panel 28 is held in position by plastic rivets 58 trapping the folded over portion of strap end 16 and holding it in position.

Figure 7:
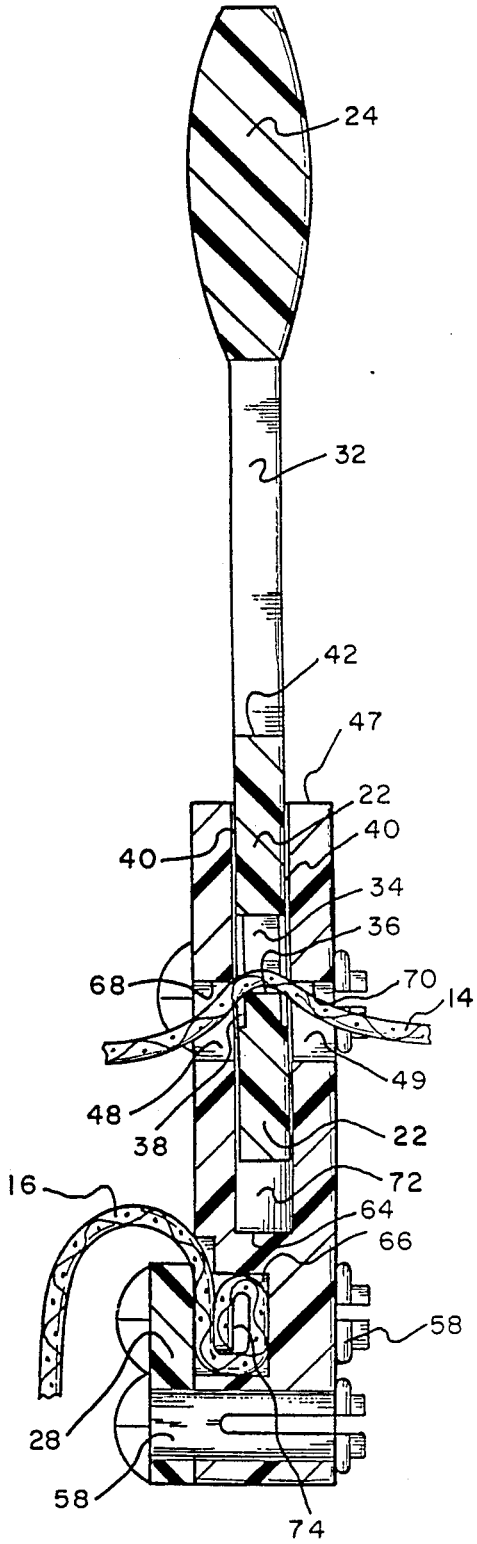
FIG. 7 is a cross-sectional view taken along lines 7—7 of FIG. 1.

In FIG. 7, handle 24 has been moved frontwardly sliding within housing opening 46 with opening space 72 at the bottom of opening 46 indicating the distance of travel. Front facing edge 36 has carried strap 14 frontwardly grabbing it against surfaces 68 and 70. An enlarged view is illustrated in FIG. 8 illustrating strap 14 being grabbed between surface 36 and inside edges 76 and 78 of surfaces 68 and 70 respectively. FIG. 9 is a diagram illustrating the position shown in FIG. 8, but eliminating the strap in order to illustrate dimensions and points hidden by the strap. One of the objects of the present invention is to provide an almost instantaneous grabbing of the strap and yet have almost immediate release of the strap when movement of the body is no longer required and the strap is to be disengaged from the slot and unwound from around the body. The position shown in FIG. 9 illustrates how the device grabs the strap and also essentially immediately releases the strap without jamming the strap between the moving parts. A key element in achieving the best results of this effect is the dimensions and positioning within the device. The horizontal distances X are the distances from the frontward edges of face 36 and the inside edges of faces 68 and 70. If vertical lines are drawn from inside corner 76 and from corner 80 of edge 36, the horizontal distance between these lines is the measurement designated "X". Likewise, if vertical lines are drawn from corner 78 and from cornere 82 of edge 36, the horizontal distance between these parallel lines is also the measurement of "X". From a practical standpoint, this distance "X" is a measurement of how much space is provided for strap 14 to extend in an arc as it is grabbed by surface 36 at its outside corners. The thickness designated "Y" is a lightly compressed thickness of strap 14. "Compressed" thickness is the thickness attained with a micrometer with a ¼ inch face closed firmly but not squeezed. It has been found that if the radio of X to Y is about 0.8 to 0.9, the best performance is achieved wherein the strap is essentially immediately grabbed with little or no slippage when center panel 22 is pulled frontwardly. In addition, strap 14 is essentially immediately released without any jamming tendency when the force is removed from center panel 22. For most strap materials and most thicknesses of strap materials, effective results can be obtained when the ratio of X over Y is in the range of 0.6 to about one. As the ratio is increased to about one, there is significant jamming with thicker straps and a lot of jamming with thinner straps. As the ratio is lowered to about 0.6, some of the fabric materials do not grab as quickly and as the thickness of the strap is increased, there is significant slippage before grabbing. For relatively supple strapping materials, such as cotton, the ratio range of X over Y may be increased to as much as 0.3 to 1.0. As the ratio is approaching 0.3, there is some grabbing with the softer cotton but essentially no grabbing with nylon strap. When the ratio is increased toward and above 1.5, there is almost always jamming of the device even with more rigid straps requiring that substantial force be applied to disengage the strap from the device with the attendant wear and tear on the strap and the device. The degree of compression observed with various straps depends on the weave of the strap, the type of fiber and the thickness of the strap. A typical strap may have a thickness of about 38 millimeters which is compressed to about 30 millimeters under light pressure. The strap material may vary considerably and although cotton straps have the advantage of a wider range of effective dimensions within the device, cotton has significantly less strength and high wear than is observed with nylon or polyester strap material.

Device 10 is constructed of a polymeric plastic molding in three parts, not counting the plastic rivets. Engineering plastics such as polycarbonate, nylon, polyacetal, such as DELRIN II, unreinforced or reinforced with fiber glass, graphite, KEVLAR or other reinforcing materials provide the strength necessary and durability of the moving parts. However, nonengineering plastics such as polypropylene, high density polyethylene, and like polymeric plastics are quite effective when less strength is required. Of course, the parts may be produced from metal, including steal, aluminum and various alloys. While device 10, as illustrated, appears suitable for lifting relatively compact lower mass objects, which may be lifted by a person with one arm, it should be apparent that handle 24 may be replaced by a hook or eye to which a winch may be attached to lift or drag the body as desired. The device of the present invention is very effective in dragging very heavy objects up ramps for loading and unloading from trucks or warehouse using a wench attached to an eye extending and attached to center panel 22. The objects lifted with the present invention include boxes as illustrated filled with ten reams of copy paper, rolled rugs or linoleum, bags of limestone or fertilizer, watermelons, stacks of 2×4 studs, and virtually any object, as long as the object is not too heavy for the device, the force is available to lift or drag the body and the body is not so unwieldy as to not be able to be moved by a single strap. Objects that are too large in volume such that even a slight offset in the centering of the strap will exert substantial forces in tilting the device, would not be suitable. However, combinations of two or more of the devices can be utilized to lift or move essentially any object.

The distance Z is the vertical distance between face 36 and a line joining faces 68 and 70. This distance is typically small, but it is unusual and it is not preferred for face 36 to move forwardly past faces 68 and 70 when the strap is grabbed. Typically, the difference between thickness Y and distance X is about equal to distance Z. For example, if the compressed thickness of the strap is about 30 millimeters, a preferred X distance is about 25 millimeters and the vertical distance Z will be about 5 millimeters. Actually, since edge face 36 does not generally reach the line joining 68 and 70, distance Z is generally not zero and the actual distance between edge 76 and edge 80 or the distance between edge 78 and edge 82 is slightly greater than the horizontal distance between extensions of those edges. However, since distance Z is typically small, the diagonal difference is close to the horizontal distance.

While this invention has been described with reference to the specific embodiments disclosed herein, it is not confined to the details set forth and the patent is intended to include modifications and changes which may come within and extend from the following claims.

I claim:

1. A device to move a body capable of being moved with a single strap comprising:

(a) a centerl panel having a front portion facing frontwardly toward a direction the body will be moved, a rear portion facing rearwardly toward the body to be moved, and two faces, (b) a movement attachment means attached to the center panel proximate the front edge to connect to a movement means to cause the center panel to be moved longitudinally in a plane of the center panel frontwardly and rearwardly, (c) a housing comprising a pair of housing panel members fixed in a parallel face to face relationship with the faces of the center panel interposed between opposing faces of the housing panel members, the distance between the faces being sufficient to allow the center panel to freely side frontwardly and rearwardly between the housing panel members, (d) a strap of a length sufficient to encircle around the body to be moved, with one end attached to the housing in lateral alignment with the front portion and the other end free, (e) a center panel opening through the center panel forming a front surface with two first edges oriented laterally with and facing the front portion, and (f) a pair of housing openings through each housing panel member oriented laterally with the front portion, the housing openings:

(i) being positioned opposed to each other and in alignment with each other, (ii) each forming a second edge oriented laterally with the front portion, opposing an adjacent first edge, and facing rearwardly, and (iii) being positioned such that they are alignable with the center panel opening by movement of the center panel to form a slot-like opening of sufficient size and shape to receive the free end of the strap, wherein the strap has a thickness and the distance between the cneter panel first edges and the adjacent housing panel edge on each side are sufficient to essentially immediately catch the strap between the second edges of the housing panel openings and the first edges of the center panel opening when the movement attachment means is moved frontwardly and essentially immediately release the strap when the movement attachment means is moved rearwardly.

2. The device of claim 1 further comprising a stop means to stop rearward movement of the center panel and align the center panel opening with the housing panel openings.

3. The device of claim 1 wherein the housing panel members have outside faces facing in opposite directions and the strap is attached to a first outside face proximate to a rear portion of the housing, the strap being fed rearwardly with the free end of the strap fed through the slot-like opening through the opposite outside housing panel face after the strap is encircled around the body to be moved.

4. The device of claim 3 wherein a distance between a strap attachment position on the first outside face and the second edge of the housing opening is about $\frac{1}{4}$ inch to about one inch.

5. The device of claim 1 wherein the movement attachment means is a handle.

6. The device of claim 1 wherein a ratio of the distance between the center panel first edges and the housing panel second edges to a compressed thickness of the strap is about 0.6 to about one.

7. The device of claim 1 wherein a ratio of the distance between the center panel first edges and the housing panel second edges to a compressed thickness of the strap is about 0.7 to about one.

8. The device of claim 1 wherein a ratio of the distance between the center panel first edges and the housing panel second edges to a compressed thickness of the strap is about 0.8 to about 0.9.

9. The device of claim 1 wherein the relationship between the strap thickness and the distance between the center panel first edges and the housing panel edges on each side to essentially immediately catch the strap between the second edges of the housing panel openings and the first edges of the center panel opening when the movement attachment means is moved toward the front and essentially immediately release the strap when the movement attachment means is moved toward the rear is expressed by the following formula:

$$x/y=k$$

wherin x is the distance between the center panel first edges and the housing panel second edges, y is a compressed thickness of the strap, and k is a ratio in the range of about 0.7 to about 1.0.

10. A device to lift a body capable of being lifted with a single strap comprising:

(a) a center panel having an front edge and two faces, the center panel being upstanding such that the faces are vertically aligned, (b) a handle means attached to the center panel proximate the front edge to allow the center panel to be vertically lifted or lowered, (c) a housing comprising a pair of housing panel members fixed in a parallel face to face relationship with the center panel interposed between opposing faces of the housing panel members, the distance between the faces being sufficient to allow the center panel to freely side up and down between the housing panel members, (d) a strap of a length sufficient to encircle vertically around the body to be lifted, with one end attached in a horizontal alignment to the housing and the other end free, (e) a horizontally oriented slot through the center panel forming a lower surface with two lower edges, and of a size and shape to receive the free end of the strap, and (f) a pair of horizontally oriented slot-like openings through each housing panel member, the openings:

(i) being positioned opposed to each other and in alignment, (ii) each forming an upper surface with an upper edge, and (iii) being positioned such that the slot is alignable with the openings as the center panel is moved vertically, wherein the relationship between the strap thickness and the distance between adjacent lower edges and upper edges is sufficient to essentially immediately catch the strap between the upper edges of the openings and the lower edges of the slot when the handle means is lifted and essentially immediately release the strap when the handle means is moved downwardly to place slack in the strap.

11. The device of claim 10 wherein the housing panel members have outside faces facing in oppoiste directions and the strap is attached to one outside face proximate to and below the opening through that panel member and the free end is fed through the opening in the opposite outside face after the strap is encircled around the body to be lifted.

12. The device of claim 11 wherein a distance between a strap attachment position on the outside face and the upper edge of the housing opening is about $\frac{1}{4}$ inch to about one inch

13. The device of claim 10 further comprising a stop means to stop downward movement of the center panel and align the slot with the housing panel openings.

14. The device of claim 10 wherein the handle means is a handle.

15. The device of claim 10 wherein a ratio of the distance between the center panel first edges and the housing panel second edges to a compressed thickness of the strap is about 0.6 to about 1.0.

16. The device of claim 10 wherein a ratio of the distance between the center panel first edges and the housing panel second edges to a compressed thickness of the strap is about 0.7 to about one.

17. The device of claim 10 wherein a ratio of the distance between the center panel first edges and the housing panel second edges to a compressed thickness of the strap is about 0.8 to about 0.9.

18. The device of claim 10 wherein the relationship between the strap thickness and the distance between the center panel first edges and the housing panel edges on each side to essentially immediately catch the strap between the second edges of the housing panel openings and the first edges of the center panel opening when the movement attachment means is moved upwardly and essentially immediately release the strap when the movement attachment means is moved downwardly is expressed by the following formula:

$$x/y=k$$

wherin x is the distance between the center panel first edge and the housing panel second edge, y is a compressed thickness of the strap, and k is a constant in the range of about 0.7 to about 1.0.

19. A method to move a body of a size and shape sufficient of being moved with a single strap comprising:

(a) providing a center panel having a front edge, a rear edge, and two faces, (c) forming a housing comprising fixing a pair of housing panel members in a parallel face to face relationship and interposing the center panel between opposing faces of the housing panel members, the distance between the faces being sufficient to allow the center panel to freely side back and forth between the housing panel members, (d) attaching one end of a strap to the housing in lateral alignment with the front edge and leaving the other end free, the strap being of a length sufficient to encircle the body to be moved, (e) forming a center panel opening through the center panel forming a first edge oriented laterally with and facing the front edge, (f) forming a pair of housing openings oriented laterally with the front edge through each housing panel member, the housing openings:

(i) being positioned opposed to each other and in alignment with each other, and (ii) each forming a second edge oriented laterally with the front edge, opposing the first edge, and facing toward the rear, (g) positioning the housing openings such that they are alignable with the panel opening by movement of the center panel, (h) sliding the center panel toward the rear to form an unobstructed slot-like opening through both housing openings and through the center panel opening of sufficient size and shape to receive the free end of the strap, (i) encircling the strap around the body to be moved, (j) inserting the free end of the strap through the slot-like opening from the side opposite that where the other end of the strap is attached, (k) pulling the strap taut around the body, (l) sliding the center panel frontwardly catching the strap between the second edges of the housing panel openings and the first edge of the center panel opening, and (m) pulling the front edge of the center panel with sufficient force to move the body.

20. The method of claim 19 further comprising moving the center panel rearwardly to essentially immediately release the strap.

* * * * *